US008431846B2

(12) United States Patent
Lyu

(10) Patent No.: US 8,431,846 B2
(45) Date of Patent: Apr. 30, 2013

(54) TRANSFER DEVICE FOR AUTOMATIC TRANSFER SWITCH

(75) Inventor: Jae Goo Lyu, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 297 days.

(21) Appl. No.: 12/855,105

(22) Filed: Aug. 12, 2010

(65) Prior Publication Data

US 2011/0036695 A1 Feb. 17, 2011

(30) Foreign Application Priority Data

Aug. 14, 2009 (KR) ..... 10-2009-0075299

(51) Int. Cl.
*H01H 9/20* (2006.01)

(52) U.S. Cl.
USPC ..... 200/50.32; 200/331

(58) Field of Classification Search ..... 200/329–332, 200/17 R, 18, 50.01, 50.28–50.33
See application file for complete search history.

(56) References Cited

U.S. PATENT DOCUMENTS

| | | | | |
|---|---|---|---|---|
| 4,286,242 | A | 8/1981 | Mrenna et al. | |
| 4,760,278 | A | 7/1988 | Thomson | |
| 5,288,958 | A * | 2/1994 | Grunert et al. | 200/331 |
| 5,929,405 | A | 7/1999 | Wehrli, III et al. | |
| 6,486,421 | B1 * | 11/2002 | Jones et al. | 200/50.32 |

FOREIGN PATENT DOCUMENTS

| | | |
|---|---|---|
| CN | 1238545 | 12/1999 |
| CN | 1320939 | 11/2001 |
| EP | 1150316 | 10/2001 |
| JP | 7161265 | 6/1995 |
| JP | 2001-351483 | 12/2001 |
| KR | 20-0183457 | 5/2000 |

OTHER PUBLICATIONS

Japanese Office Action dated May 25, 2012.
Chinese Office Action dated Dec. 7, 2012, and an English language translation thereof.

* cited by examiner

*Primary Examiner* — Tulsidas C Patel
*Assistant Examiner* — Marina Fishman
(74) *Attorney, Agent, or Firm* — Greenblum & Bernstein, P.L.C.

(57) ABSTRACT

Disclosed is a transfer device for an automatic transfer switch. With the configuration of the transfer device, the transfer device, which is installed between a plurality of air circuit breakers to allow switching of a closed state and a tripped state of the plurality of air circuit breakers, can be modularized so as to be easily assembled. A length of a transmission rod can be adjusted so as to facilitate assembly and maintenance of the transfer device and also minimize the probability of occurring an assembly error, allowing accurate closing and trip operations. The transmission rod may be provided with a buffer to reduce impact noise generated upon switching of the closing and trip operations of each air circuit breaker and enhance reliability of the device. Also, the transmission rod can be formed with a preset thickness without being curved (bent), thereby avoiding the transmission rod from being curved (bent), resulting in preventing a mis-operation from occurring during the closing and trip operations.

6 Claims, 7 Drawing Sheets

TRANSFER DEVICE FOR AUTOMATIC TRANSFER SWITCH

CROSS-REFERENCE TO RELATED APPLICATION

Pursuant to 35 U.S.C. §119(a), this application claims the benefit of earlier filing date and right of priority to Korean Application No. 10-2009-0075299, filed on Aug. 14, 2009, the contents of which is incorporated by reference herein in its entirety.

BACKGROUND OF THE INVENTION

1. Field of the Invention

The present invention relates to a transfer device for an automatic transfer switch, and particularly, to a transfer device for an automatic transfer switch, by which various electric components are allowed to be continuously supplied with stable power in a manner of blocking one air circuit breaker from being mechanically electrically closed when another air circuit breaker is closed due to a switching of states between the two air circuit breakers.

2. Background of the Invention

In general, hospitals or telephone offices, in which power failure should not happen, use an automatic transfer switch (hereinafter, referred to as ATS) in order to ensure stable power supply. The ATS includes therein a regular air circuit breaker (hereinafter, referred to as a first ACB) and an emergency air circuit breaker (hereinafter, referred to as a second ACB). The first and second ACBs are mechanically connected to each other to be switched to each other. Accordingly, when a fault current is applied to one of the two ACBs, such fault current is detected. Consequently, a closed ACB is tripped and simultaneously another ACB is closed so as to be switched to each other. The switching of the ACBs allows a constant supply of stable power.

Upon allowing the switching of the two ACBs for use, the two ACBs are typically connected to each other via a wire or a thin iron bar for allowing an interlocking of the ACBs.

FIGS. 1 and 2 are perspective views showing an example of a related art device for interlocking two ACBs using a thin iron bar. Referring to FIGS. 1 and 2, the related art ATS includes frames 11 and 21 installed at the ACBs 1 and 2, respectively, closing links 12 and 22 rotatably coupled to the frames 11 and 21, respectively, to be rotatable by respective closing levers (not shown) installed within each ACB 1 and 2, trip links 13 and 23 rotatably installed in the frames 11 and 21, respectively, at one sides of the corresponding closing links 12 and 22 so as to cooperate with respective trip levers (not shown) installed in each ACB 1 and 2, and transmission rods 14 and 24 connected between the closing links 12 and 22 and the trip links 13 and 23 so as to transfer a rotational force. Here, the closing links 12 and 22 and the trip links 13 and 23 are installed independent of each other, and each of the transmission rods 14 and 24 is made of an integrally rigid material.

With the configuration of the related art ATS, when the first ACB 1 is closed, the first closing link 12 is rotated counterclockwise in the drawing due to the first closing lever installed in the first ACB 1. Responsive to this, the first transmission rod 14 is pulled upwardly such that the second trip link 23 of the second ACB 2 installed at a lower side in the drawing is moved upwardly. Here, an interlock lever is also moved upwardly by the second trip link 23, accordingly, the second trip lever installed in the second ACB 2 is pushed up such that the second ACB 2 is switched (transferred) to a tripped state.

When the first closing link 12 is restored by a restoring spring (not shown), the pulled first transmission rod 14 is moved back to its original position and the second trip link 23 is also moved back to its original position, thereby releasing the tripped state of the second ACB 2.

In the meantime, a procedure that the second ACB 2 is switched to a closed state and the first ACB 1 to a tripped state is performed in an opposite manner to the aforesaid procedure.

However, in the structure of the ATS of the related art, since the closing links 12 and 22 and the trip links 13 and 23 are independently installed, a problem is caused that a process of assembling the closing links 12 and 22 and the trip links 13 and 23 becomes complicated.

Also, a length of each transmission rod 14, 24 should be adjusted by cutting off the transmission rod 14, 24, which makes it difficult to fabricate the transmission rods 14 and 24 with exactly the same length between the closing links 12 and 22 and the trip links 13 and 23, and also makes it difficult to adjust an error occurred during the assembly operation, which may cause a mis-operation to occur due to a defective assembly.

Furthermore, while each of the ACBs 1 and 2 is repeatedly closed and tripped, upon rotation of the closing links 12 and 22 and the trip links 13 and 23, an impact transferred to each transmission rod 14, 24 cannot be absorbed, thereby generating impact noise or degrading durability.

In addition, each transmission rod 14, 24 is formed of a thin rod, so it has a low intensity. Also, since each of the transmission rods 14, 24 has a structurally bent portion, it may have high possibility of being curved during operation, which may cause a mis-operation.

SUMMARY OF THE INVENTION

Therefore, an object of the present disclosure is to provide a transfer device for an automatic transfer switch capable of reducing the number of assembly processes by modularizing a closing link and a trip link of each ACB.

Another object of the present disclosure is to provide a transfer device for an automatic transfer switch capable of avoiding beforehand a mis-operation by facilitating adjustment of a length of a transmission rod between the closing link and the trip link.

Another object of the present disclosure is to provide a transfer device for an automatic transfer switch capable of reducing noise and increasing durability by allowing an impact generated upon repetition of closing and tripling of each ACB to be absorbed at the transmission rod.

Another object of the present disclosure is to provide a transfer device for an automatic transfer switch, capable of avoiding in advance (minimizing) a mis-operation caused due to a transmission rod being curved or the like upon a switching operation, in a manner of increasing an intensity of the transmission rod.

To achieve these and other advantages and in accordance with the purpose of the present invention, as embodied and broadly described herein, there is provided a transfer device for an automatic transfer switch including closing links and trip links disposed to be rotatable in cooperation with a closing operation and a trip operation of a plurality of air circuit breakers, respectively, and transmission rods each having both ends coupled to the corresponding closing link and trip link to allow cooperation of the closing operation and the trip operation of the plurality of air circuit breakers, wherein each of the transmission rods comprises a length-adjusting unit configured to allow adjustment of the length of the transmission rod in a state that both ends thereof are coupled the corresponding closing link and trip link.

Each of the transmission rods may be configured by a plurality of links provided in pair, one ends of the links provided in pair may be coupled to the closing links and the trip links, respectively, and another ends thereof may be screw-coupled to each other so as to adjust lengths of the transmission rods.

Each of the transmission rods may be provided with a closing side transmission link and a trip side transmission link, and a nut-type length-adjusting unit may be provided between the closing side transmission link and the trip side is transmission link so as to couple the same in a manner of coupling with a nut.

Each of the transmission rods may include a buffer configured to absorb an impact generated when a position of the transmission rod is changed in response to operations of the closing link and the trip link.

Each of the plurality of air circuit breakers may include a frame base, and a frame cover may be coupled to one side surface of each frame base with a preset interval, the closing link and the trip link being rotatably coupled between the frame base and the frame cover.

The closing link may be rotatably coupled to one side surface of each frame base, a link configuring the transmission rod may be rotatably coupled to one side of the closing link, and a closing lever for selectively rotating the closing link may be slidably coupled to another side of the closing link.

The trip link may be rotatably coupled to one side surface of each frame base, a trip lever for operating an interlock lever for maintaining and releasing a tripped state of each air circuit breaker may be rotatably coupled to another side surface of the frame base, and the trip link and the trip lever may be coupled to each other with interposing the frame base therebetween so as to cooperate with each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of a transfer device for an automatic transfer switch according to the exemplary embodiment, with reference to the accompanying drawings.

Figure 1:
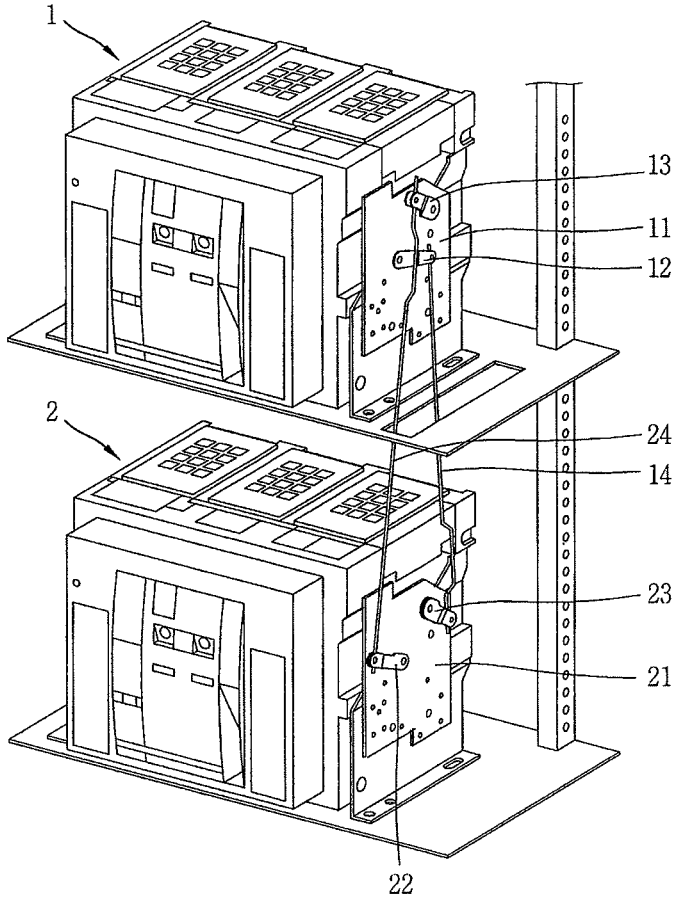
FIG. 1 PRIOR ART
FIG. 1 is a perspective view of an automatic transfer switch according to the related art.
Figure 2:
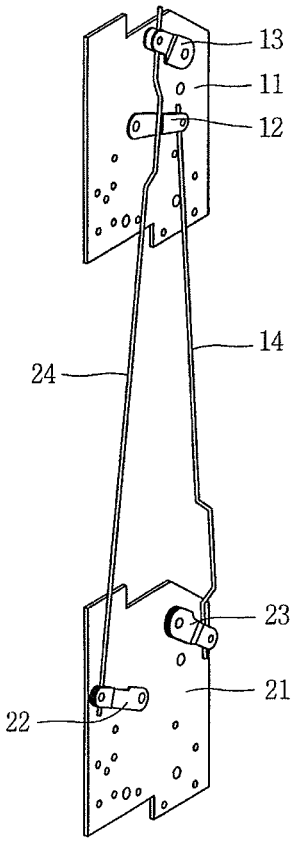
FIG. 2 PRIOR ART
FIG. 2 is a perspective view showing a transfer device of FIG. 1.
Figure 3:
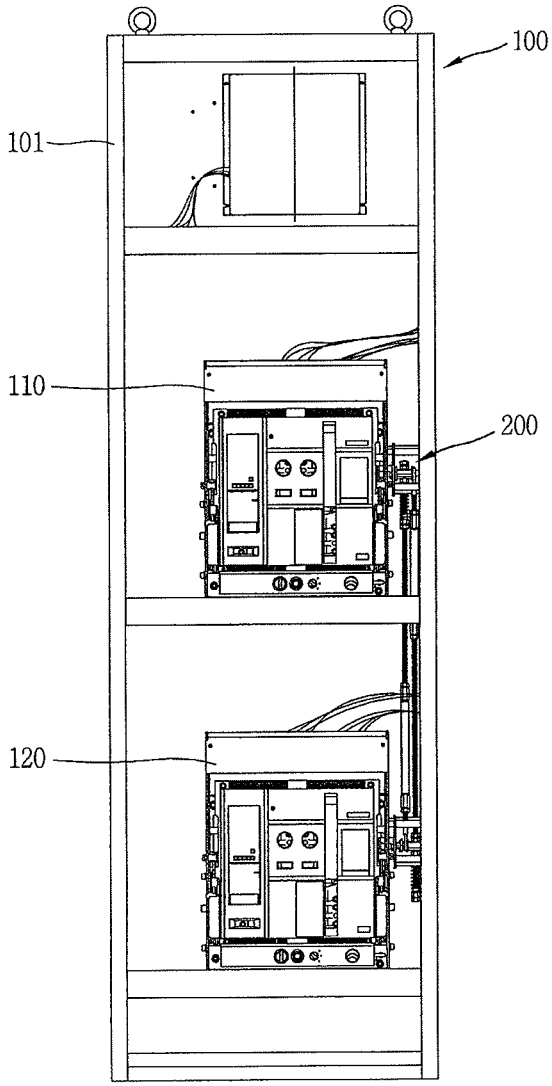
FIG. 3 is a front view showing an automatic transfer switch in accordance with an exemplary embodiment of the present disclosure.
Figure 4:
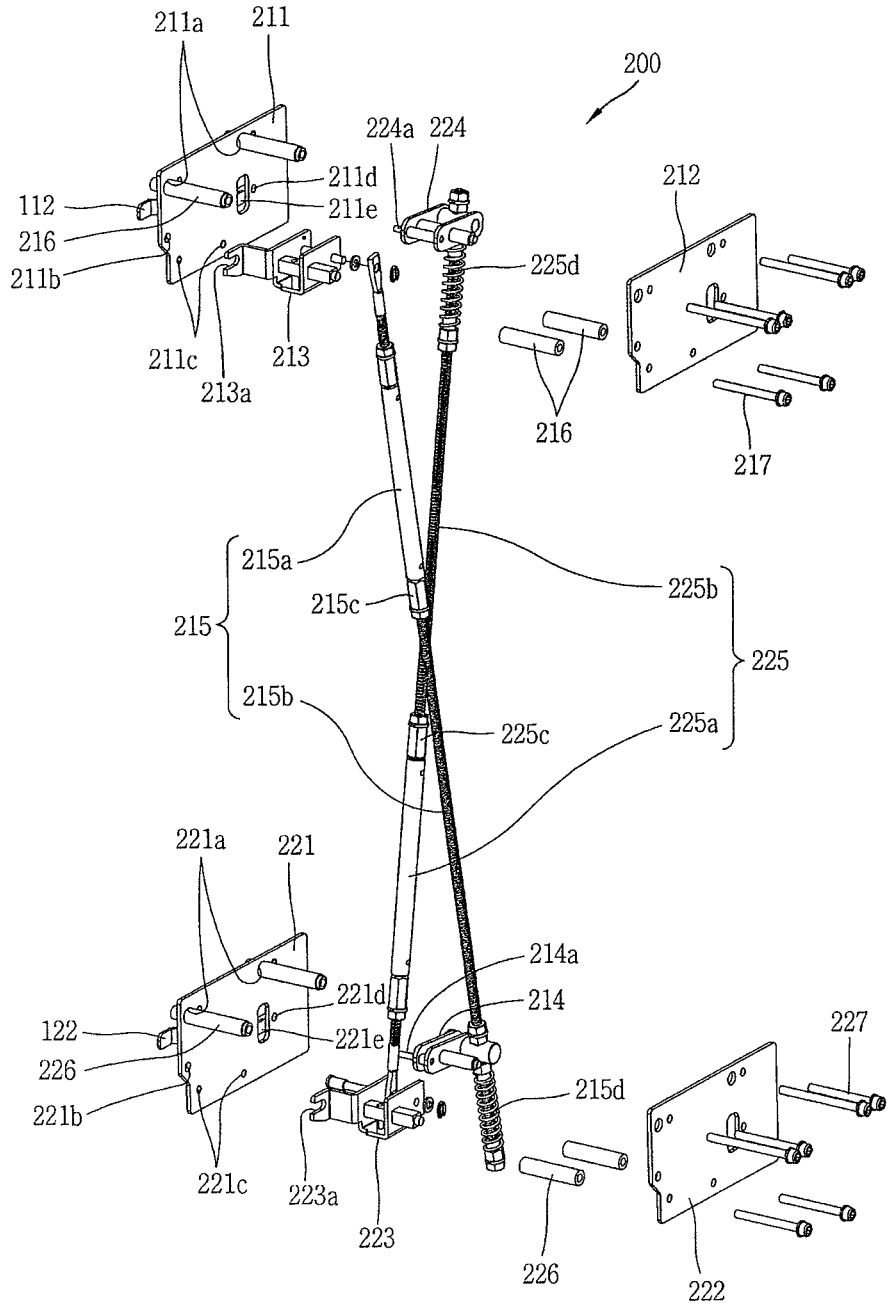
FIG. 4 is a perspective view of a transfer device disassembled from the automatic transfer switch of FIG. 3.
Figure 5:
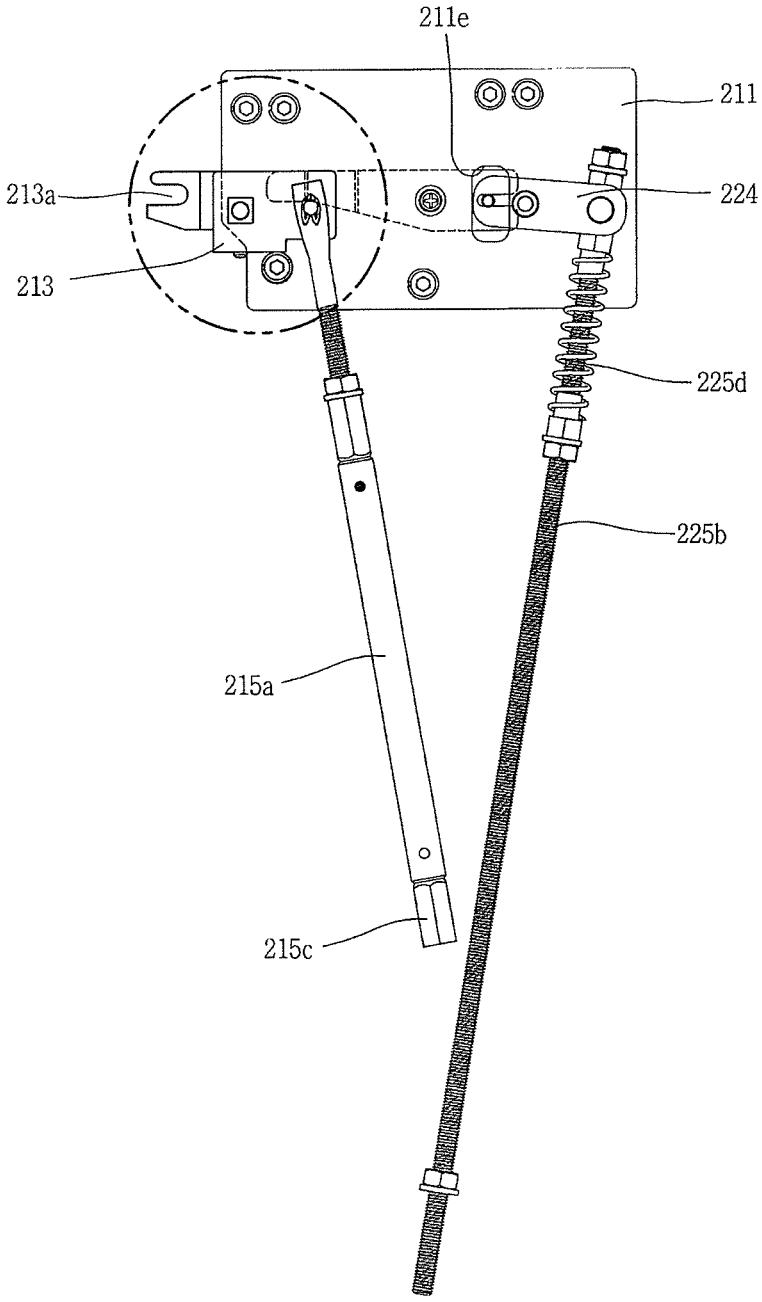
FIG. 5 is a front view showing a partially assembled state of the transfer device of FIG. 3.

FIG. 3 is a front view showing an automatic transfer switch in accordance is with an exemplary embodiment, and FIG. 4 is a perspective view of a transfer device disassembled from the automatic transfer switch of FIG. 3.

Referring to FIG. 3, an automatic transfer switch (ATS) 100 may include a case 101 having an accommodation space partitioned into upper and lower spaces, a regular ACB (first ACB) 110 disposed in the upper accommodation space of the case 101, and an emergency ACB (second ACB) 120 disposed in the lower accommodation space of the case 101. A transfer device 200 for alternately closing or tripping both the ACBs 110 and 120 may be installed in one side of the inner space of the case 101, namely, in one sides of the first and second ACBs 110 and 120.

The transfer device 200 may be modularized to be easily installed between the first ACB 110 and the second ACB 120. For instance, referring to FIG. 4, the transfer device 200 may include a first frame base 211 and a second frame base 221 disposed at one side surfaces of the first ACB 110 and the second ACB 120, respectively, a first frame cover 212 and a second frame cover 222 coupled to one side surfaces of the first and second frame bases 211 and 221, respectively, with preset intervals, a first closing link 213 and a first trip link 214 coupled to be present between the frame bases 211 and 221 and the frame covers 212 and 222, respectively, so as to selectively perform a closing operation and a trip operation, a second closing link 223 and a second trip link 224 coupled to be present between the frame bases 211 and 221 and the frame covers 212 and 222, respectively, so as to selectively perform the closing operation and the trip operation with moving opposite to the first closing link 213 and the first trip link 214, and a first transmission rod 215 and a second transmission rod 225 respectively having both ends coupled to the first closing link 213 and the first trip link 214 and is the second closing link 223 and the second trip link 224, respectively, so as to allow cooperation of the closing operation and the trip operation of both of the ACBs 110 and 120.

Each of the first frame base 211 and the second frame base 221 may be formed in a shape of an approximately rectangular panel. Near edges of the first and second frame bases 211 and 221 are shown, respectively having coupling holes 211*a* and 221*a* for fixing the first and second frame bases 211 and 221 to one side surfaces of the ACBs 110 and 120, respectively, through holes 211*b* and 221*b* for coupling of the closing links 213 and 223, respectively, coupling holes 211*c* and 221*c* for fixing the frame covers 212 and 222, respectively, and the like. At central portions of the frame bases 211 and 221 are shown, having through holes 211*d* and 221*d* for coupling of the trip links 224 and 214, respectively. At one sides of the through holes 211*d* and 221*d* for coupling of the trip links 224 and 214, respectively, are shown, having sliding holes 211*e* and 221*e* coupled with the trip links 224 and 214 and the trip levers 112 and 122, respectively, so as to allow rotation of the trip links 224 and 214 and the trip levers 112 and 122.

The first frame cover 212 and the second frame cover 222 may be coupled to outer side surfaces of the frame bases 211 and 221, respectively, with preset intervals. To this end, a plurality of pins 216 and 226 for maintaining the intervals may be disposed along edges of each frame base 211 and 221 and each frame cover 212 and 222, so as to be fixed by bolts 217 and 227, respectively. Some of the plurality of pins 216 and 226 may be engaged with one side surfaces of the ACBs 110 and 120, respectively, via the frame bases 211 and 221.

Figure 6:
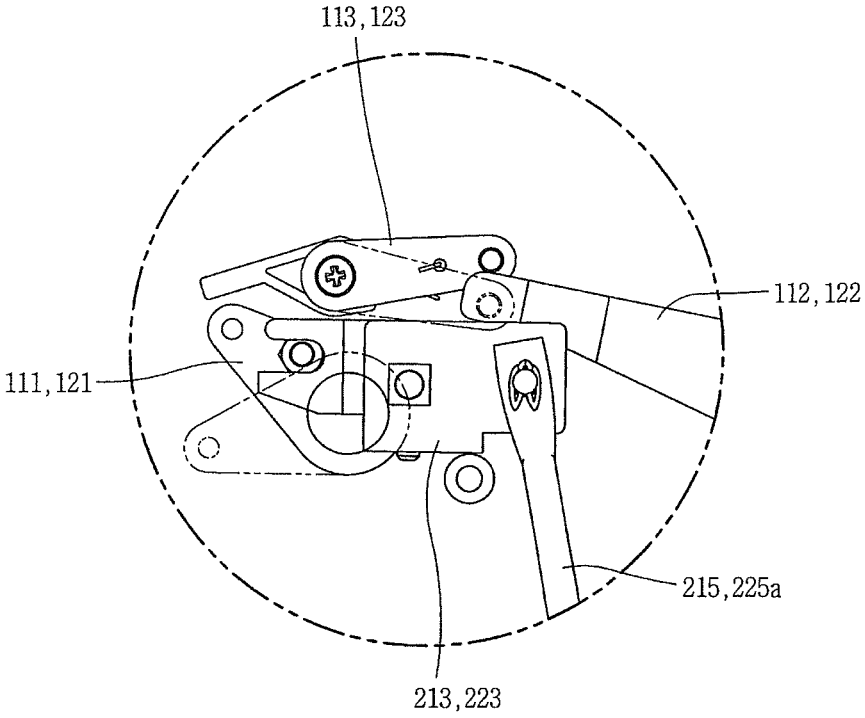
FIGS. 6 and 7 are an overview and a perspective view, respectively, showing a coupled state between a link and a lever of the transfer device of FIG. 5.
Figure 7:
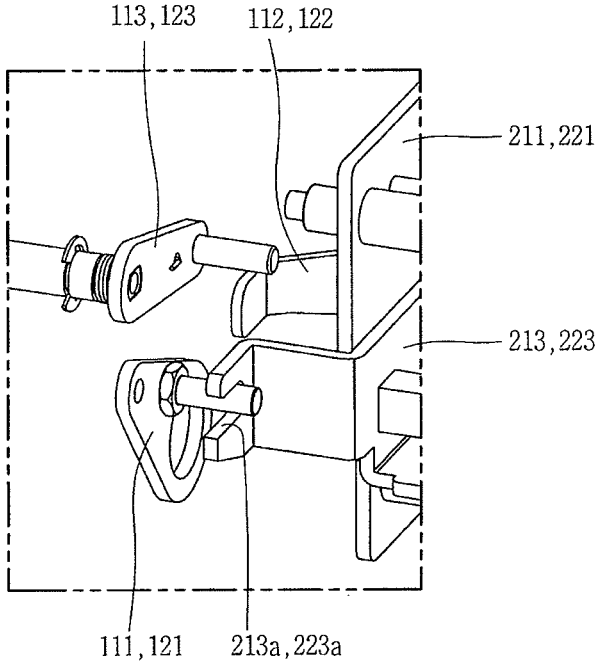

The first closing link 213 may be rotatably installed at the through hole 211*b* disposed at the edge of the first frame base 211. A first closing side is transmission link 215*a* of the first transmission rod 215 to be explained later may be rotatably coupled to one end of the first closing link 213. A coupling groove 213*a* for allowing a closing lever 111 (see FIG. 6) of the first ACB 110 to be slidably rotated may be formed at another end of the first closing link 213 long in a lengthwise direction.

The first trip link 214 may be rotatably installed at the through hole 221*d* present at the central portion of the second frame base 221. A first trip side transmission link 215*b* of the first transmission rod 215 to be explained later may be rotatably coupled to one end of the first trip link 214. A pin 214*a* inserted through the sliding hole 221*e* of the second frame base 221 may be coupled to another end of the first trip link 214. The pin 214*a* may be slidably coupled to the trip lever 122 of the second ACB 120. The trip lever 122 of the second ACB 120 may be coupled to an interlock lever 123 (see FIG. 6) of the second ACB 120 so as to operate the interlock lever 123 for maintaining or releasing a tripped state of the second ACB 120.

The first transmission rod 215 may be provided with a plurality of links having one ends coupled to the first closing link 213 and the first trip link 214, respectively. For example, the first transmission rod 215 may include a first closing side transmission link 215*a* and a first trip side transmission link 215*b*. The first closing side transmission link 215*a*, as aforesaid, may have one end, which is rotatably coupled to the first closing link 213 so as to be movable up and down responsive to a direction that the first closing link 213 rotates. A nut-type length-adjusting unit 215*c* may be formed at another end of the first closing side transmission link 215*a*, namely, at another end which is not coupled to the first closing link 213, such that an end of the first trip side transmission link 215*b* is inserted thereinto to be coupled by a screw.

The first trip side transmission link 215*b*, as aforesaid, may have one end rotatably coupled to the first trip link 214. A screw thread, which is to be inserted into the length-adjusting unit 215*c* of the first closing side transmission link 215*a* to be screw-coupled, may be formed at another end of the first trip side transmission link 215*b*, namely, at another end which is not coupled to the first trip link 214. At one ends of the first and second transmission rods 215 and 225 coupled with the first and second trip links 214 and 224, respectively, are shown, having buffers 215*d* and 225*d* configured as compression coil springs for attenuating impacts applied to the transmission rods 215 and 225, respectively, when the first and second transmission rods 215 and 225 are closed or tripped.

Here, the second closing link 223 may be substantially the same as the aforesaid first closing link 213 in its shape and assembled position except for being coupled to the second frame base 221 and coupled to a second closing side transmission link 225*a* of the second transmission rod 225.

Also, the second trip link 224 may be substantially the same as the aforesaid first trip link 214 in its shape and assembled position except for being coupled to the first frame base 211 and coupled to a second trip side transmission link 225*b* of the second transmission rod 225.

The second transmission rod 225 may be substantially the same as the first transmission rod 215 in its configuration and operation principle excluding members assembled thereto and its position.

Hereinafter, description will be given of a process that the first ACB 110 and the second ACB 120 are alternately tripped and closed in the automatic transfer switch.

Figure 8:
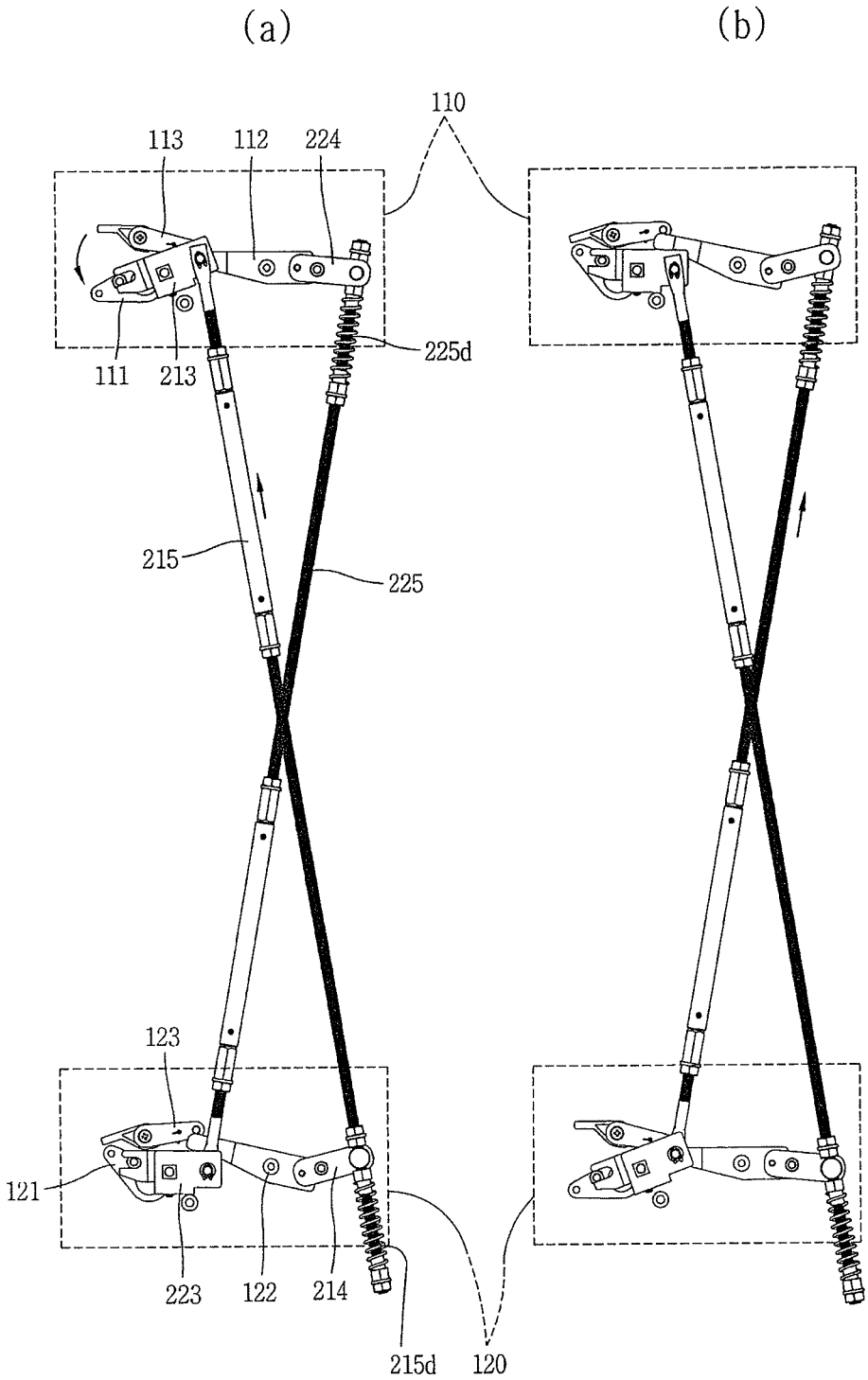
FIG. 8 is a front view showing an operation of the transfer device of FIG. 3.

First, when the first ACB 110 is closed, as shown in FIG. 8A, a closing link driving lever 111 connected to the first ACB 110 rotates in a counterclockwise direction in the drawing. The first closing link 213 accordingly rotates in a counterclockwise direction in the drawing, and the first transmission rod 215 connected between the first closing link 213 of the first ACB 110 and the first trip link 214 of the second ACB 120 moves upwardly. In response to the upward movement of the first transmission rod 215, the first trip link 214 rotates in the counterclockwise direction in the drawing. The trip lever 122 of the second ACB 120 is pushed up due to the rotation of the first trip link 214. As the trip lever 122 of the second ACB 120 is pushed up, the interlock lever 123 of the second ACB 120 operates such that the second ACB 120 is tripped.

When the first ACB 110 is tripped, the first closing link 213 moves back to its original position and the first trip link 214 of the second ACB 120 is also restored to its original position by virtue of the first transmission rod 215. When the first trip link 214 is restored, the trip lever 122 of the second ACB 120 is moved back to its original position. Accordingly, the second ACB 120 is released from the interlocked state, thereby being able to be closed.

On the other hand, referring to FIG. 8B, when the second ACB 120 is closed, as aforesaid, a closing link driving lever 121 of the second ACB 120 rotates in a counterclockwise direction in the drawing and simultaneously the second closing link 223 rotates in a counterclockwise direction in the drawing. Accordingly, the second transmission rod 225 connected between the second closing link 223 of the second ACB 120 and the second trip link 224 of the first ACB 110 moves upwardly. In response to the upward movement of the second transmission rod 225, the second trip link 224 rotates in the counterclockwise direction in the drawing to push up the trip lever 112 of the first ACB 110. Consequently, the trip lever 112 installed in the first ACB 110 operates to mechanically interlock the first ACB 110 to prevent the first ACB 120 from being electrically closed.

When the second ACB 120 is tripped, the second closing link 224 moves back to its original position and the second trip link 224 of the first ACB 110 is also restored to its original position by virtue of the second transmission rod 225. In response to the restoring of the second trip link 224, the trip lever 112 of the first ACB 110 moves back to its original position. Accordingly, the first ACB 120 is uninterlocked, thereby being able to be closed.

As described above, a transfer device which is installed between plural ACBs to make the plural ACBs alternately switched to a closed state and a tripped state may be modularized, thereby facilitating an assembly of the transfer device.

A length of a transmission rod configuring part of the transfer device can be adjusted, which allows the transfer device to be easily assembled and repaired or maintained and also reduces the probability of occurrence of an assembly error so as to enable more accurate closing and trip operations.

Also, as a buffer is installed at the transmission rod, an impact, which may occur upon switching the closing and trip operations of each ACB, can be absorbed, thereby reducing impact noise and enhancing reliability.

In addition, the transmission rod is formed with a preset thickness without being curved, so curving or bending of the transmission rod can be avoided in advance, whereby a misoperation during the closing and trip operations may not occur.

The foregoing embodiments and advantages are merely exemplary and is are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A transfer device for an automatic transfer switch comprising:

frame bases provided in a plurality of air circuit breakers, respectively;

frame covers each coupled to one side surface of a corresponding frame base;

closing links and trip links disposed between the frame bases and the frame covers to be rotatable in cooperation with a closing operation and a trip operation of a plurality of air circuit breakers, respectively;

transmission rods each having both ends coupled to the corresponding closing link and trip link to allow cooperation of the closing operation and the trip operation of the plurality of air circuit breakers, and a length-adjusting unit configured to allow adjustment of the length of each transmission rod such that both ends of each transmission rod is coupled to the corresponding closing link and trip link, wherein the closing link and the trip link have central portions rotatably coupled to the frame base and the frame cover, and the transmission rod is rotatably coupled to one end of the closing link and trip link, wherein coupling grooves having respective closing levers slidably coupled thereto are provided at each other end of the closing links and have a slit shape, the closing levers selectively rotating the closing links, and trip levers that operate as an interlock lever are rotatably coupled to each other end of the trip links, the interlock lever maintaining or releasing a trip state of each air circuit breaker, and wherein elongated sliding holes are provided on each of the frame bases and the frame covers, each elongated sliding hole transferring a rotational force of the trip link to the trip lever while a coupled portion between the trip link and the trip lever is rotated, based on a center of rotation of the trip link.

2. The transfer device of claim 1, wherein each of the transmission rods comprises a plurality of links provided in pairs, wherein one end of the links provided in a pair are coupled to the closing links and the trip links, respectively, and another of the links of the pair are screw-coupled to each other so as to adjust lengths of the transmission rods.

3. The transfer device of claim 2, wherein each of the transmission rods is provided with a closing side transmission link and a trip side transmission link, and a nut-type length-adjusting unit is provided between the closing side transmission link and the trip side transmission link so as to couple the closing side and the trip side transmission links in a manner of coupling with a nut.

4. The transfer device of claim 2, wherein each of the transmission rods comprises a buffer configured to absorb an impact generated when a position of the transmission rod is changed in response to operations of the closing link and the trip link.

5. The device of claim 1, wherein the frame cover is coupled to one side surface of each frame base with a preset interval between the frame base and the frame cover.

6. The transfer device of claim 3, wherein each of the transmission rods comprises a buffer configured to absorb an impact generated when a position of the transmission rod is changed in response to operations of the closing link and the trip link.

* * * * *